US006740008B1

(12) United States Patent
Ho et al.

(10) Patent No.: US 6,740,008 B1
(45) Date of Patent: May 25, 2004

(54) MULTIPURPOSE EXERCISING APPARATUS

(76) Inventors: Wei-Teh Ho, P.O. Box 24-108, Taipei (TW); Keith Mirchandani, P.O. Box 24-108, Taipei (TW)

( * ) Notice: Subject to any disclaimer, the term of this patent is extended or adjusted under 35 U.S.C. 154(b) by 0 days.

(21) Appl. No.: 10/442,365

(22) Filed: May 21, 2003

(51) Int. Cl.[7] ..... A63B 4/00; A63B 7/08

(52) U.S. Cl. ..... 482/34; 482/79; 482/146; 482/147; 482/123

(58) Field of Search ..... 482/126, 79, 140, 482/120, 91, 121, 122, 123, 129–130, 77, 148, 907, 142, 132–135; 473/569, 423–430; 273/118; 601/23, 27, 28; 472/127, 134, 135; 248/562, 599; 297/452.1, 452.41, 452.17

(56) References Cited

U.S. PATENT DOCUMENTS 5,868,688 A * 2/1999 Avidor et al. ..... 601/87
6,575,885 B1 * 6/2003 Weck et al. ..... 482/147

* cited by examiner

*Primary Examiner*—Nicholas D. Lucchesi
*Assistant Examiner*—L Amerson

(57) ABSTRACT

A multipurpose exercising apparatus is constructed to include a plastic flat base frame positionable on a flat surface, the base frame having a plurality of eyes spaced around the periphery thereof, a semispherical shell made from polyurethane and covered on the base frame, the semispherical shell having a plurality of raised portions over the outer surface thereof for imparting a massaging effect to the user using the multipurpose exercising apparatus, and a plurality of elastic pull cords selectively fastened to the eyes of the base frame for pulling by the user.

2 Claims, 6 Drawing Sheets

MULTIPURPOSE EXERCISING APPARATUS

BACKGROUND OF THE INVENTION

1. Field of the Invention

The present invention relates to an exercising apparatus and, more particularly, to a compact, inexpensive, multipurpose exercising apparatus, which is practical for home use to exercise different parts of the body.

2. Description of the Related Art

A variety of exercising apparatus have been disclosed, and have appeared on the market. However, most commercially available exercising apparatus are heavy and expensive, and provide only one particular function. These bulky and heavy exercising apparatus are not suitable for home use. People living in apartments have little house space to install a bulky and heavy exercising apparatus.

SUMMARY OF THE INVENTION

The present invention has been accomplished under the circumstances in view. It is therefore the main object of the present invention to provide a multipurpose exercising apparatus, which is compact and inexpensive, practical for home use. It is another object of the present invention to provide a multipurpose exercising apparatus, which can be used in any of a variety of forms to exercising different parts of the body. To achieve these and other objects of the present invention, the multipurpose exercising apparatus comprises a plastic flat base frame positionable on a flat surface, the base frame having a plurality of eyes spaced around the periphery thereof, a semispherical shell made from polyurethane and covered on the base frame, the semispherical shell having a plurality of raised portions over the outer surface thereof for imparting a massaging effect to the user using the multipurpose exercising apparatus, and a plurality of elastic pull cords selectively fastened to the eyes of the base frame for pulling by the user.

DETAILED DESCRIPTION OF THE PREFERRED EMBODIMENT

Figure 1:
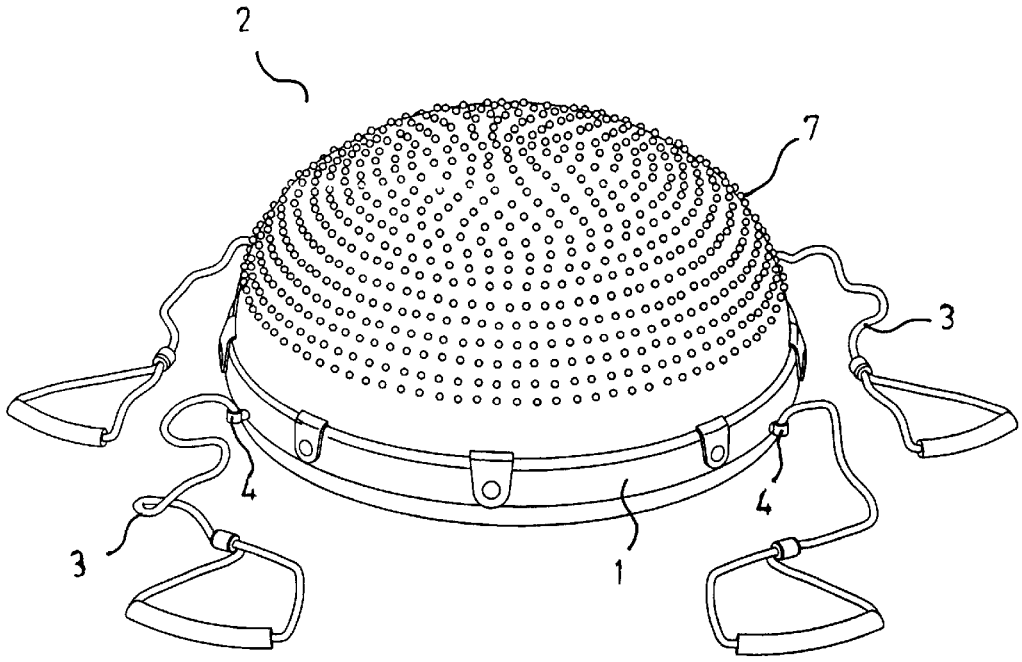
FIG. 1 is an elevational view of a multipurpose exercising apparatus according to the present invention.
Figure 2:
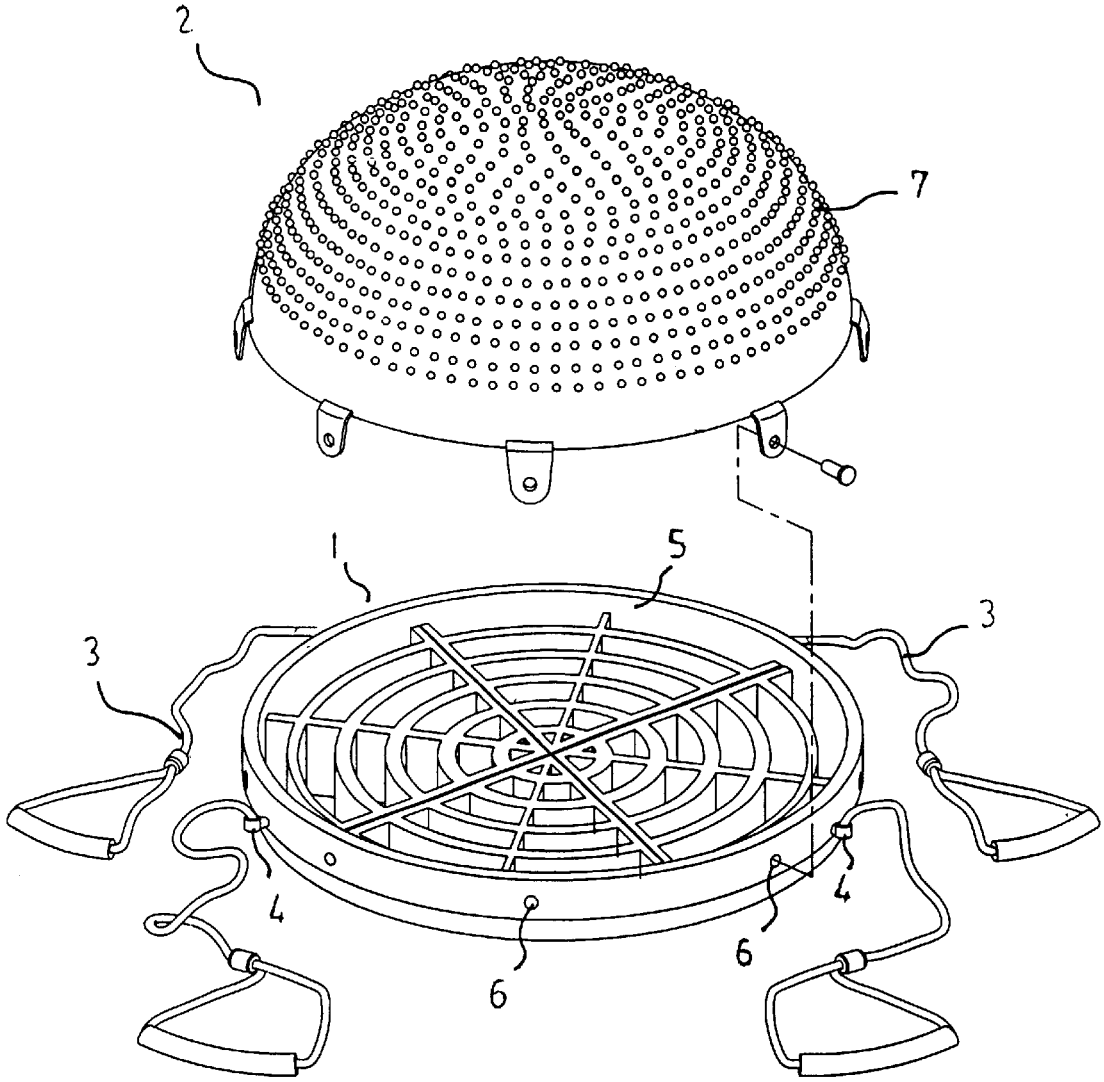
FIG. 2 is an exploded view of the multipurpose exercising apparatus according to the present invention.
Figure 3:
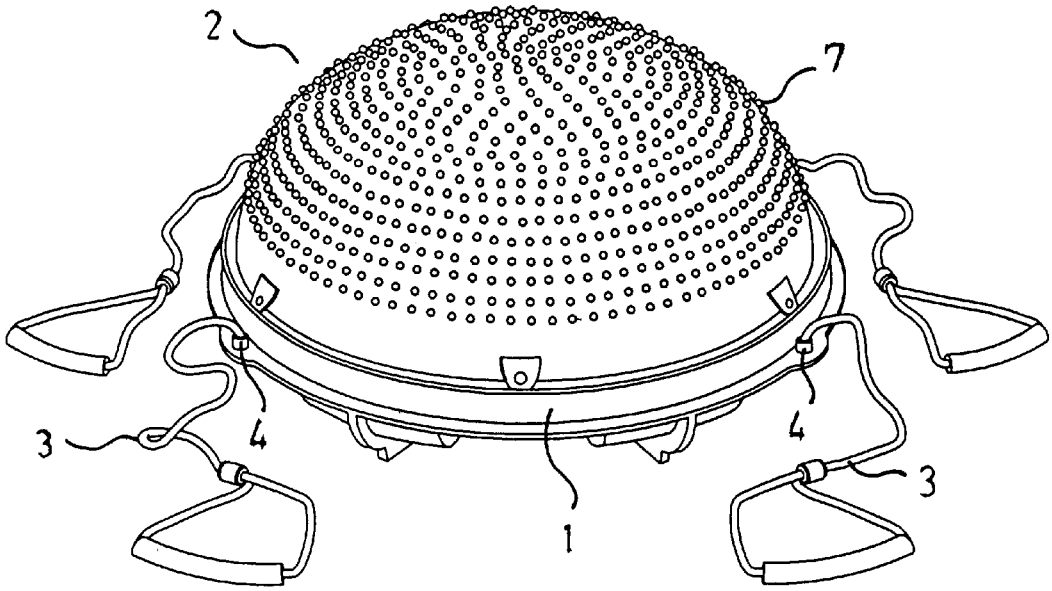
FIG. 3 is an elevational view of an alternate form of the multipurpose exercising apparatus according to the present invention.

Referring to FIGS. 1~3, a multipurpose exercising apparatus in accordance with the present invention is shown comprised of a base frame 1, a semispherical shell 2, and a plurality of elastic pull cords 3. The base frame 1 is a flat plastic frame stably positionable on the floor, comprising a plurality of eyes 4 and mounting holes 6 spaced around the periphery, and a plurality of mounting grooves 5 on the inside. The elastic pull cords 3 are respectively fastened to the eyes 4 for pulling by the user. The semispherical shell 2 is covered on the base frame 1 at the top and engaged into the mounting grooves 5 and fixedly fastened to the mounting holes 6, having a plurality of raised portions 7 over the outer surface for imparting a massaging effect to the user using the multipurpose exercising apparatus. The semispherical shell 2 is preferably molded from polyurethane through a foaming or blowing process.

Before use, the semispherical shell 2 is covered on the base frame 1 and engaged into the mounting grooves 5 and then fixedly fastened to the mounting holes 6, and then the user can decide if to use the elastic cords 3 or not.

Figure 4:
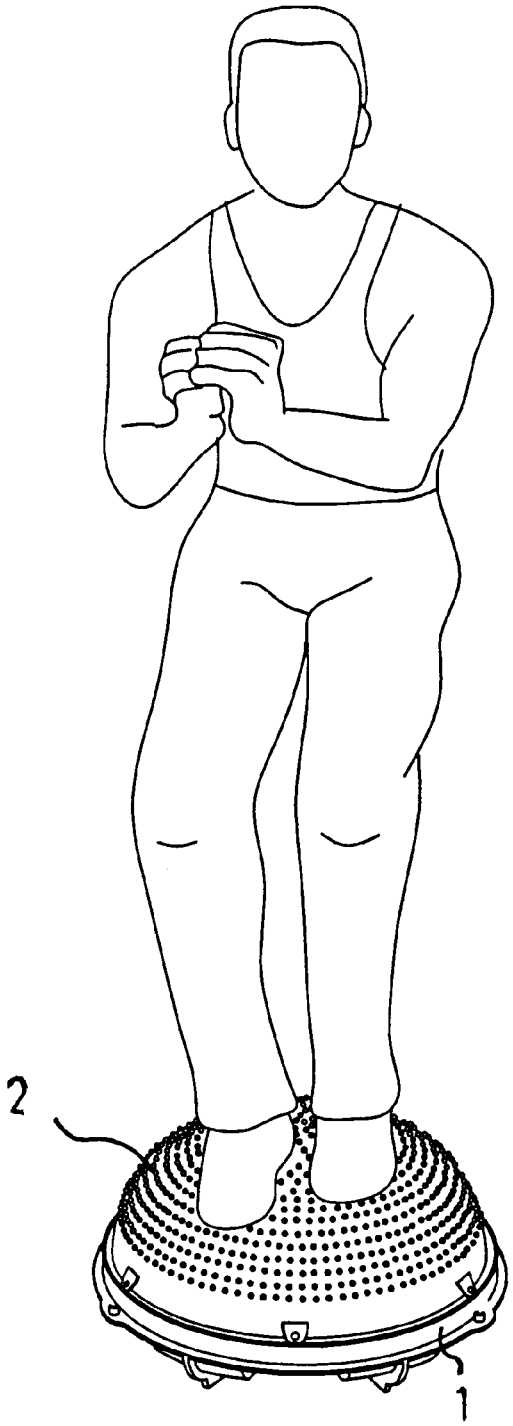
FIG. 4 shows an application example of the multipurpose exercising apparatus according to the present invention.
Figure 5:
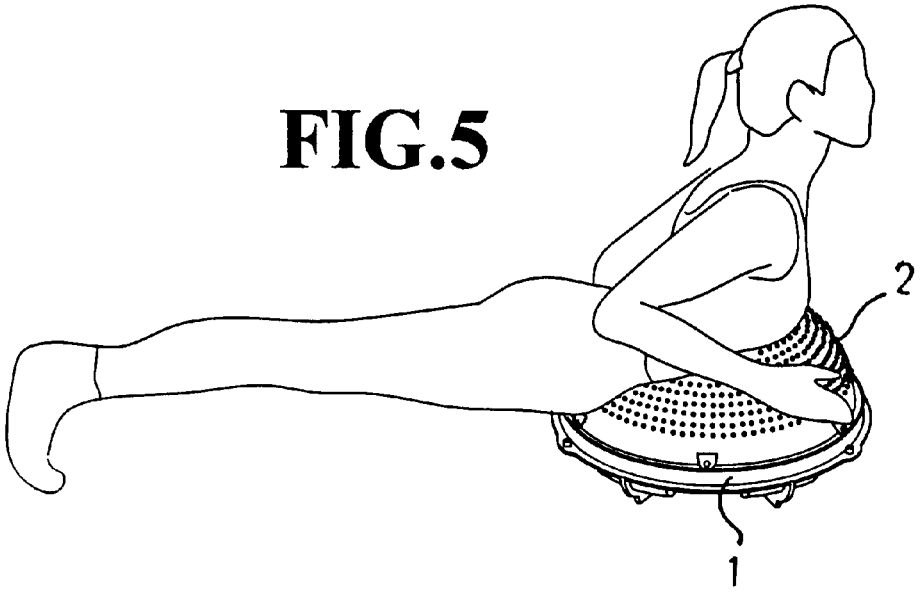
FIG. 5 shows another application example of the multipurpose exercising apparatus according to the present invention.
Figure 6:
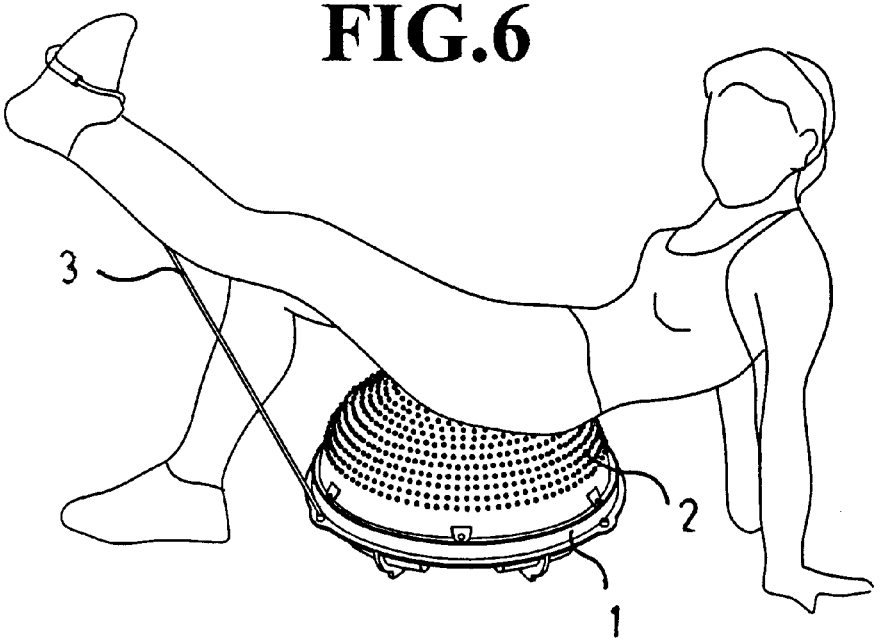
FIG. 6 shows still another application example of the multipurpose exercising apparatus according to the present invention.
Figure 7:
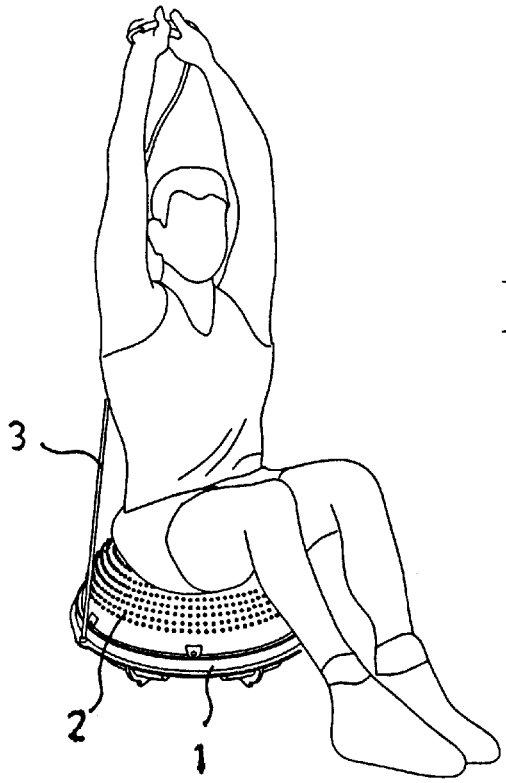
FIG. 7 shows still another application example of the multipurpose exercising apparatus according to the present invention.
Figure 8:
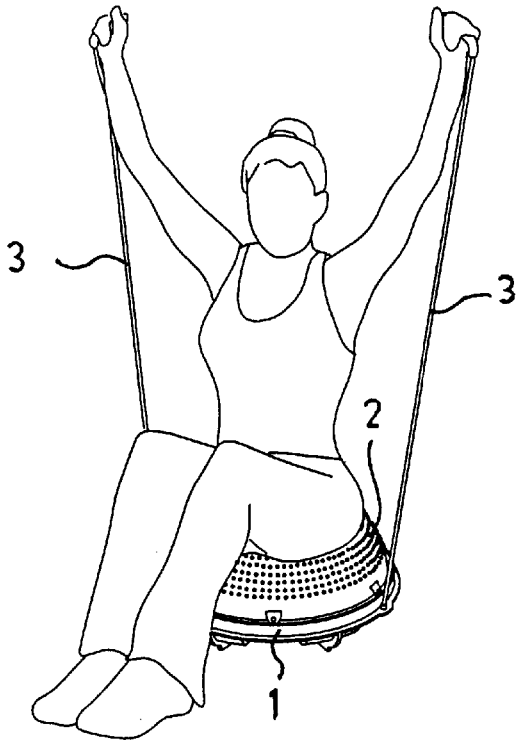
FIG. 8 shows still another application example of the multipurpose exercising apparatus according to the present invention.

FIGS. 4~8 show several application examples of the present invention. As shown in FIG. 4, the user can stand on the semispherical shell 2 and then twist the body. As shown in FIG. 5, the user can rest the front part of the body on the semispherical shell 2 and then twist the body. As shown in FIG. 6, the user can sit on the semispherical shell 2 and then alternatively exercising the legs to stretch one elastic cord 3. As shown in FIG. 7, the user can sit on the semispherical shell 2, and then pull one elastic cord 3 with both hands from the back. As shown in FIG. 8, the user can sit on the semispherical shell 2, and then pull two elastic cords 3 with the hands from two sides.

A prototype of multipurpose exercising apparatus has been constructed with the features of FIGS. 1~3. The multipurpose exercising apparatus functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A multipurpose exercising apparatus comprising:

a plastic flat base frame positionable on a flat surface, said base frame comprising a plurality of eyes spaced around the periphery thereof;

a semispherical shell made from polyurethane and covered on said base frame, said semispherical shell having a plurality of raised portions over an outer surface thereof for imparting a massaging effect to the user using the multipurpose exercising apparatus; and a plurality of elastic pull cords selectively fastened to said eyes of said base frame for pulling by the user.

2. The multipurpose exercising apparatus as claimed in claim 1, wherein said base frame comprises a plurality of mounting grooves on the inside and a plurality of mounting holes around the periphery for the mounting of said semispherical shell.

* * * * *